United States Patent [19]

Brown

[11] Patent Number: 4,513,451

[45] Date of Patent: Apr. 30, 1985

[54] VARIABLE VENTILATION SYSTEM FOR GARMENTS

[76] Inventor: Michael A. Brown, 5 Upper Trail, Fairfield, Pa. 17320

[21] Appl. No.: 468,584

[22] Filed: Feb. 22, 1983

[51] Int. Cl.[3] ..... A41B 9/100

[52] U.S. Cl. ..... 2/69; 2/DIG. 1; 2/102; 2/93; 2/115; 2/108

[58] Field of Search ..... 2/69, 79, 81, 82, 93, 2/87, 102, 108, 115, DIG. 1

[56] References Cited

U.S. PATENT DOCUMENTS

| | | | |
|---|---|---|---|
| 1,360,390 | 11/1920 | Gilfillan | 2/DIG. 1 |
| 2,079,980 | 5/1937 | Anders | 2/227 |
| 2,084,173 | 6/1937 | Wexler | 2/87 |
| 2,259,560 | 10/1941 | Glidden | 2/87 X |
| 2,715,226 | 8/1955 | Weiner | 2/79 |
| 2,989,754 | 6/1961 | Bukspan | 2/87 |
| 3,045,243 | 7/1962 | Lash et al. | 2/1 |
| 3,086,215 | 4/1963 | Di Paola | 2/93 |
| 3,153,793 | 10/1964 | Lepore | 2/78 |
| 3,213,465 | 10/1965 | Ludwikowski | 2/87 |
| 3,710,395 | 1/1973 | Spano et al. | 2/78 |
| 3,761,962 | 10/1973 | Myers | 2/79 |
| 4,185,327 | 1/1980 | Markve | 2/69 X |
| 4,408,356 | 10/1983 | Abrams | 2/87 |

FOREIGN PATENT DOCUMENTS

| | | | |
|---|---|---|---|
| 34518 | 8/1981 | European Pat. Off. | 2/87 |
| 1220511 | 5/1960 | France | 2/93 |

*Primary Examiner*—Ronald Feldbaum

*Attorney, Agent, or Firm*—James J. Brown

[57] ABSTRACT

A system is described for controllably ventilating garments such as protective suits and jackets, especially garments which are worn by the occupants or operators of moving vehicles such as motorcycles, bicycles and some aircraft. Vents are provided in the front of the garment for controllably admitting air into the garment by means of flaps or other devices which cover the vents and which can incrementally be removed to control the amount of air entering the garment. Additional vents are provided at the back and sides of the garment to allow the exiting of air and prevent billowing of the garment due to air being trapped inside. The various vents which are provided in the garment are covered with air permeable material such as mesh which advantageously is stretchable to provide greater flexibility to the garment both while it is being worn and to facilitate putting on and taking off. The ventilation system of the invention can be used in conjunction with garments of various configurations and materials including leathers, woven fabrics and waterproof material.

17 Claims, 8 Drawing Figures

VARIABLE VENTILATION SYSTEM FOR GARMENTS

BRIEF STATEMENT OF THE INVENTION

The present invention is directed to a ventilated clothing system and more particularly to a ventilation system for an outer garment such as a suit or jacket which permits a controlled flow of air through the garment and provides for increased flexibility and comfort. The invention is particularly adapted to be used in connection with a suit or jacket of the type used in the operation of moving, relatively open vehicles such as motorcycles or open aircraft where strong air flow is encountered and controllable ventilation in the garment is necessary especially during warm weather.

BACKGROUND OF THE INVENTION

Particularly in the operation of moving, relatively open vehicles such as motorcycles, bicycles, and some aircraft, the use of competent protective apparel is important. At the same time, however, many of the garments commonly used in such operations such as leather suits and jackets and even normal street apparel have had the disadvantage that poor ventilation is provided. This can be a particularly serious problem during warm or moderate weather or in climates where such weather is frequently encountered. On warm days where heat build-up in the protective suit or other attire becomes a problem, it is often the practice to remove the clothing or to merely unfasten the front of the suit in order to permit the passage of air into the suit and over the body of the wearer. As the speed of the vehicle increases, however, and the force of air against the operator becomes greater, such opened apparel can present a serious problem in the form of billowing or ballooning of the garment since there is no way to control the air flow into the garment or provision for exiting of air our of it. Thus, it is not an uncommon practice during warm weather for cyclists to disgard protective or other clothing because it cannot be sufficiently ventilated to be comfortable.

It is, accordingly, an object of the present invention to provide a ventilation system which permits the controlled flow of air through the garment.

It is another object of the present invention to provide a garment having a controlled ventilation system whereby problems of billowing or ballooning of the garment when high velocity air streams are encountered are avoided.

Still another object of the present invention is to provide a suit or jacket which is particularly adapted for use by the operators or occupants of vehicles in which such occupants or operators are exposed to air flow.

Still another object of the present invention is to provide a protective garment for use by the operators or occupants of relatively open, moving vehicles in moderate and warm climatic conditions such that controllable ventilation of the suit is achieved.

Other objects and advantages of the present will, however, become apparent upon consideration of the appended drawings and description thereof.

SUMMARY OF THE INVENTION

Figure 1:
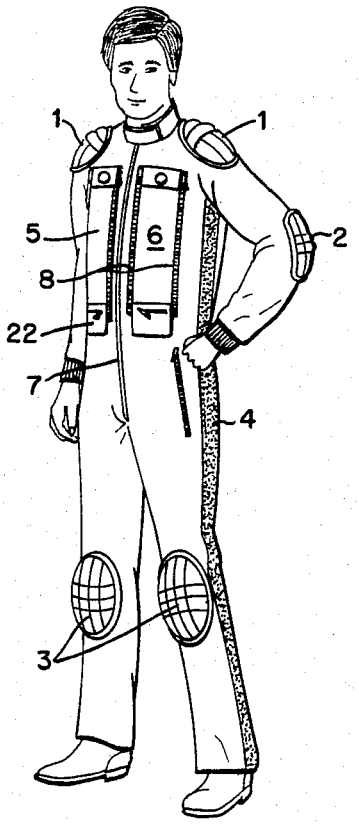
FIG. 1 is a perspective view of the protective suit of the invention as worn by a motorcycle rider.

In accordance with the present invention a system is provided for ventilating garments in such a way that a comfortable flow of air through the garment is provided without distorting its configuration. The system of the invention includes one or more vents in the front of the garment for controllably permitting air to enter the garment and one or more vents disposed in the back and/or sides of the garment for permitting air to exit therefrom. Entry of air into the garment through the front vents is controlled by means of flaps which cover the vents and are attached to the garment in such a manner as to permit the flaps to be incrementally positioned over the front vents.

The vents which are provided in accordance with the present invention for both permitting air to enter and exit the garment are apertures in the garment material of appropriate configuration which are covered with an air permeable material that permits passage of air therethrough. The material of which the garrment is made can be of any suitable material appropriate for the type of garment specifically provided. For example nylon or other synthetic fibers either alone or in blend with cotton or other fibers can be used or the jacket can be constructed of leather and various non-fibrous and water-impervious materials. The air-permeable material used to cover the vents or apertures can be a mesh or perforated fabric which provides minimal wind resistance.

In one preferred embodiment of the present invention, front vents are provided in the form of vertical apertures disposed alongside one another and extending from about the underarms of the garments to the waist. These frontal vents for admitting air into the garment are covered with flaps attached to the garment in such a way that they can be incrementally positioned over the respective vents to control the flow of air through the aperture and into the garment. Vents are also provided in the back and/or sides of the garment to permit exiting of the air entering from the front. Typically a vent is provided in the middle top of the back of the garment and horizontally across the lower portion of the back. As in the case of the frontal vents, these vents in the back are apertures which are covered with a perforated material which permits air to flow through it. In one embodiment of the invention the vent extending horizontally across the lower portion of the back can be covered with a flap of material which extends down over it.

In a particularly preferred embodiment of the present invention, the ventilated garment is a suit with arms and legs. Such a suit can, in addition to the ventilation means already described, be provided with vertical vents extending up the outside of each leg from a point at the cuff or bottom of the garment leg to under the arms. It will be clear that such a garment can be structured in many convenient ways to permit access thereto such as by a zipper down the front. In addition, where the garment is specifically designed to provide protection, for example to a cycle rider, abrasion resistant material can be provided in critical areas such as the knees, elbows and shoulders.

It is particularly preferred that the air permeable fabric which is used to close the ventilation apertures in accordance with the present invention be a stretchable mesh type of fabric so that, in addition to providing ventilation and permitting the passage of air therethrough, it will also stretch, at points of stress thereby providing a better fit and accessibility for the garment and facilitating movement by the wearer. The upper back vent for example can be a wedge shaped aperture extending from the collar portion of the garment downward along the center line of the back. By providing a stretchable mesh fabric to cover this vent, greater lateral stretching across the shoulders and upper back of the garment is achieved. This is particularly important in the case where the garment is intended to be used by the riders of cycles where the arms are extended forward by the individual in a crouching position thereby placing stress across the shoulders and upper back. By providing a similar stretchable material for the side apertures along the legs and torso of the garment, additional freedom of movement is provided to the wearer and putting on and taking off are facilitated.

The present invention will however be more fully appreciated by having reference to the appended drawings.

In FIG. 1 of the drawings the ventilation system of this invention is shown as used in an outer protective garment especially adapted for use by cyclists. Padded protective reinforcement is shown at the shoulders 1, elbows 2 and knees 3 of the suit of the invention which is conveniently opened for ease of access by a zipper 7 extending from the crotch of the suit to the neck. Frontal vents 5 and 6 are provided on either side of the zipper 7 on the front torso of the suit for controllably admitting a flow of ventilating air into the suit. Further vents 4 are provided on either side of the suit extending from the leg cuff up under the arms of the suit.

Figure 2:
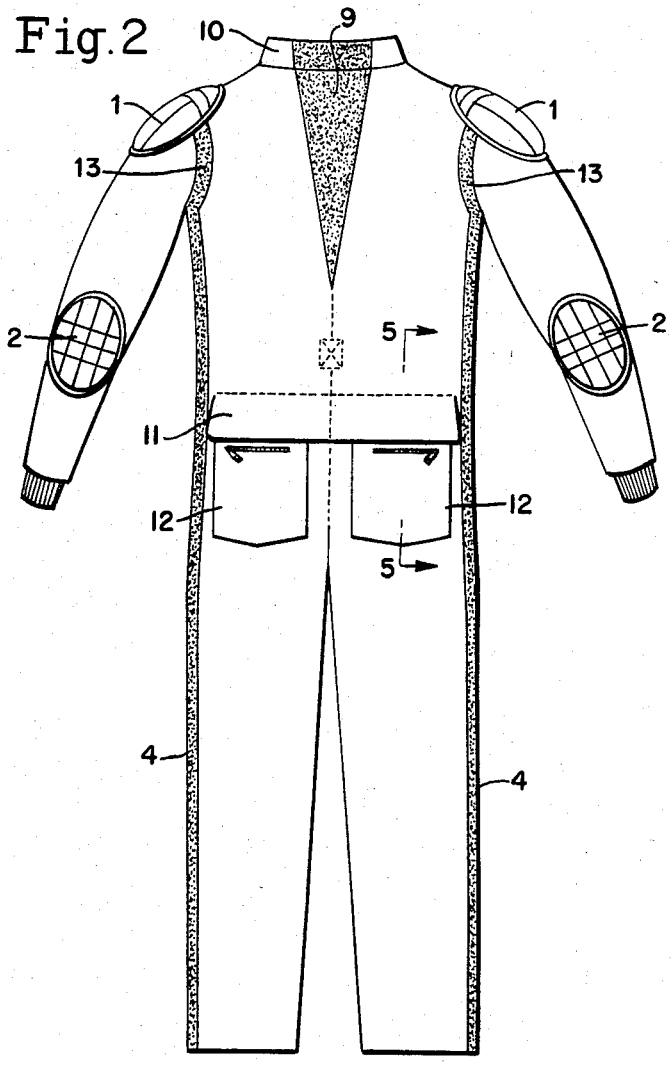
FIG. 2 is a rear elevational view of the garment of the present invention.
Figure 5:
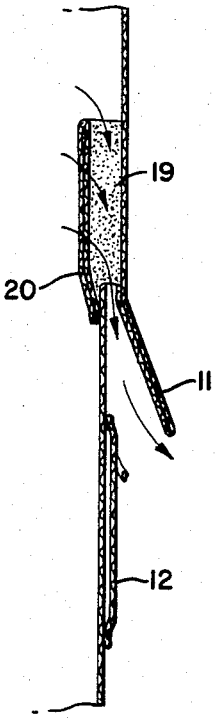
FIG. 5 is a fragmentary cross-section view taken along lines 5—5 of FIG. 2 showing rear and high billowing air vents with cover flap.

Directing attention to FIG. 2, the back of the garment shown in FIG. 1 is illustrated and includes dual zippered pockets 12 as well as a flap 11 extending horizontally across the lower portion of the back to cover a vent (not shown) which similarly extends horizontally across the lower back of the suit and which is illustrated in greater detail in FIG. 5 of the drawings. An additional vent 9 in the shape of a wedge or inverted pyramid extends from the collar 10 vertically downward to provide for further venting of air which has entered the front of the suit and to facilitate putting the suit on and taking it off. Additional venting of the suit is provided by extending the vents 4 running along either side of the suit up around the arm junctures 13. Each of these vents for permitting exit of air from the suit is essentially an aperture of the indicated configuration in the suit which is covered by one or more layers of a perforated fabric material such as a stretchable mesh.

Figure 3:
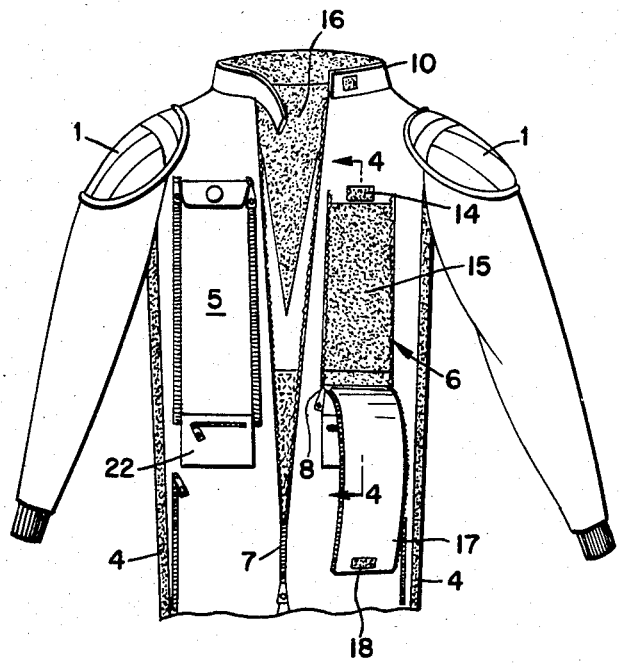
FIG. 3 is a partial front elevational view of a suit unzipped to show air vents.

Directing attention to FIG. 3 of the drawings, the two parallel front vents for controllably admitting air into the suit for example during operation of a motorcycle by the wearer of the suit in warm weather, is illustrated in greater detail. The vents 5 and 6 provided in the front of the jacket are each covered by a flap of material which typically will be the same as that of the rest of the suit. Vent 6 illustrates that the flap 17 is attached at its bottom to the body of the suit and is provided on either side with zippers or other closures 8 which permit the flap to be removed in degrees from the face of the vent. The vent itself is covered with a perforated stretchable mesh material 15 which permits the passage of air into the body of the jacket when the flap is uncovered. Further closure of the flap 17 is conveniently provided by means of velcro or other fasteners at 14 and 18. Additional air permeable mesh fabric is shown at 16 corresponding to the back vent 9 for allowing venting of air from the suit.

Figure 4:
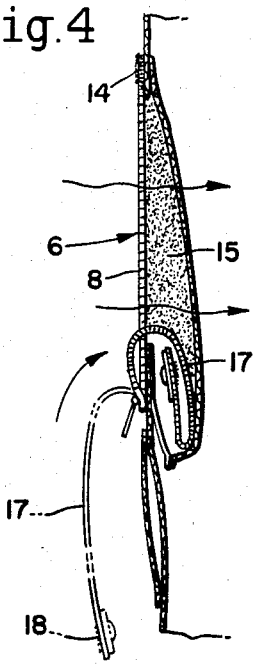
FIG. 4 is a fragmentary cross-section taken along lines 4—4 of FIG. 3 showing a front air vent pocket open for maximum air flow.

FIG. 4 of the drawings is a side view of the front vent 6 showing air flow through the air permeable mesh 15. The cover flap 17 is shown as it can conveniently rolled up and tucked in a cavity between inner pocket 22 and the mesh material 15 formed immediately below the vent.

FIG. 5 of the drawings illustrates a side view of the lower back horizontal vent which extends across the lower back of the suit to permit air to exit the suit as shown by the arrows. The lower portion of the vent is covered by the flap 11 while mesh material 19 permits the flow of air from the outside through the vent 20.

Figure 6:
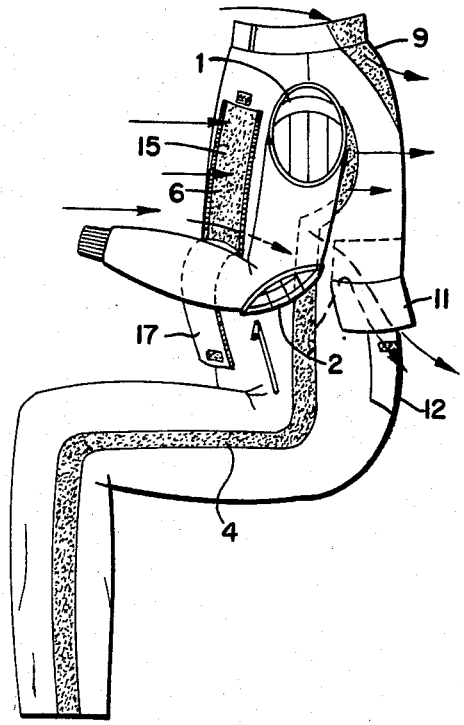
FIG. 6 is a side elevational view of the suit in riding position showing air flow.

In FIG. 6 of the drawings the flow of air into the suit through the vent 6 in the front and exiting of air through the vents 4, 9 and 11 in the side upper back and lower back is illustrated by means of arrows.

Figure 7:
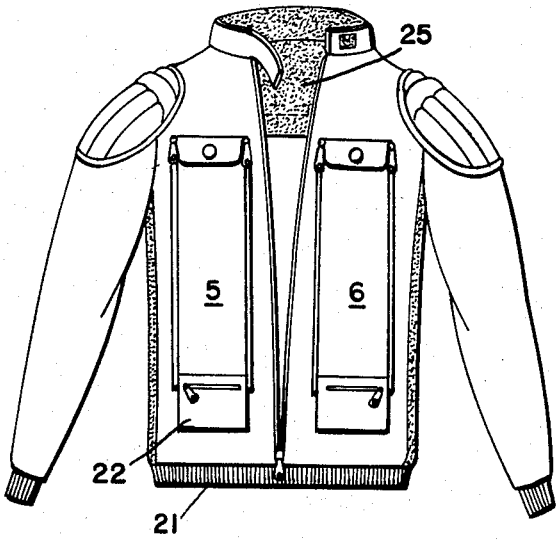
FIG. 7 is a front view of a jacket having the ventilation provisions of the present invention.

FIG. 7 of the drawings illustrates an embodiment of the garment of the present invention wherein a water resistant jacket rather than a full length suit is provided having a waist band 21 and a protected back vent 23 having air permeable mesh 25 and covered by a flap 24. It will be noted that in other respects the jacket shown in the drawing is substantially the same as the full length suit previously described, the main difference being that the jacket illustrates the provision of venting in a water resistant garment in which water cannot enter through the vent.

Figure 8:
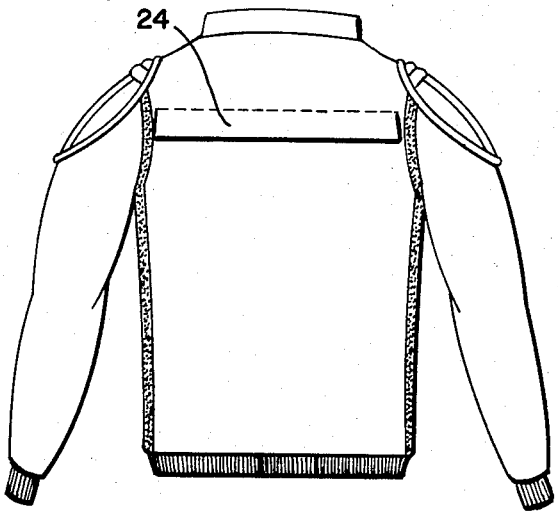
FIG. 8 is a rear view of the jacket of FIG. 7 illustrating waterproof venting in the back.

It will be appreciated that the garment of the present invention can take several forms such as that of a vest which would be similar to the jacket shown in FIGS. 7 and 8 except that the arms would be missing. Additionally, the body of the garment can be made in different configurations and of various materials such as leather, water-resistant or impermeable fabrics or various lightweight, stretchable and breathable fabrics which may be particularly desirable during the warmer seasons of the year or insulated or lined material for use in cooler or changing environments. Although the present invention has been described with particular reference to its application as a protective garment adapted for use by cyclists and those occupying or operating moving vehicles where substantial air velocity is encountered, it will also be appreciated that the ventilation system of the present invention has application in numerous other modes especially where improved ventilation in the garment is desirable or necessary, such as where heavy manual exertion is involved.

A further feature of the present invention is that the provision of stretchable mesh material particularly in the upper back vent provides for increased lateral stretching of the garment across the upper back such as when the arms are extended forward during the operation of cycles. Similarly, the provisions of stretchable mesh fabric in the panel across the lower back provides vertical flexibility and along the sides of the full length garment to improve the comfort and flexibility of the garment and decrease binding and pulling which typically occurs in such clothing and also facilitate putting on or taking off of the garment. Other advantages and embodiments of the present invention will, however, be apparent to those of ordinary skill in the art.

What is claimed is:

1. A ventilated outer garment comprising a front, back and two sides, said garment front being provided with one or more ventilation means disposed on the front of the garment for controllably permitting moving air to enter said garment and pass through said garment; the back of the garment being further provided with additional ventilation means for permitting said moving air to exit therefrom to thereby prevent billowing of the garment; entry of air through said front ventilation means being controlled by covering means disposed over said ventilation means and attached to said garment by means for permitting said covering means to be incrementally positioned over said front ventilation means.

2. The garment of claim 1 wherein said ventilation means are apertures in said garment which are covered with air permeable material to permit passage of air therethrough.

3. The garment of claim 1 wherein two ventilation means are provided in the back, one of which extends horizontally across the lower portion thereof and is covered with a flap and the other of which extends vertically downward from the top of the back.

4. The garment of claim 3 wherein additional ventilation means are provided in each side of said sides.

5. The garment of claim 4 wherein said ventilation means are covered with air-permeable, material extending vertically essentially the full length of each side of the garment.

6. The garment of claim 1 which is a suit adapted to enclose the torso, arms and legs.

7. The garment of claim 1 which is a vest.

8. The garment of claim 1 which is a jacket.

9. The garment of claim which is made of water-resistant material.

10. The garment of claim 2 wherein said back ventilation means is an aperture extending horizontally across the upper back and covered with a flap also extending horizontally across the upper back of the garment.

11. The garment of claim 10 which is a water-proof jacket.

12. The garment of claim 3 wherein said ventilation means are apertures in said garment covered with air permeable material to permit passage of air therethrough.

13. The garment of claim 12 wherein said air permeable material is stretchable mesh.

14. The garment of claim 13 wherein the air permeable material covering the aperture extending from the top of the back stretches horizontally across the back and the air permeable material covering the aperture extending horizontally across the lower back is vertically stretchable.

15. A ventilated outer garment the front of which is provided with one or more means for controllably permitting moving air to enter said garment and to pass through said garment, the back and sides extending along said legs being provided with ventilation means for permitting said moving air to exit from said garment to thereby prevent billowing of the garment; entry of air through said front ventilation means being controlled by means covering said ventilating means and attached to said garment by means for permitting said covering means to be incrementally positioned over said ventilation means; one of said ventilation means in the back extending horizontally across the lower portion of the torso and being covered by a flap and another means extending vertically downward from the top of the back, all of said ventilation means being apertures in said garment provided with air permeable material to permit the passage of air therethrough.

16. The garment of claim 9 wherein said air permeable material is stretchable mesh fabric.

17. A system for controllably ventilating garments adapted to be worn over at least the upper body, said system comprising one or more vent means in the front of said garment for controllably admitting moving air into the garment and one or more vent means otherwise disposed in the garment for permitting said moving air to exit therefrom to thereby prevent billowing of the garment, entry of air into the garment through said front vent means being controlled by cover means disposed over said vent means and attached to the garment to permit said cover means to be incrementally positioned over said front vent means.

* * * * *